US007717584B1

(12) United States Patent
Tuan

(10) Patent No.: US 7,717,584 B1
(45) **Date of Patent: *May 18, 2010**

(54) VIBRATING AND TWINKLING LED BACKLIGHTING DEVICE

(76) Inventor: Wei-Jei Tuan, P.O. Box 166-13, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/292,870

(22) Filed: Nov. 28, 2008

(51) Int. Cl.
*F21V 21/08* (2006.01)

(52) U.S. Cl. ..... 362/103; 362/249.02; 362/295; 362/394; 362/570

(58) Field of Classification Search ..... 362/103, 362/105–106, 249.05, 295, 394, 555, 570, 362/294.02, 800
See application file for complete search history.

(56) References Cited

U.S. PATENT DOCUMENTS 6,059,414 A * 5/2000 Tsai ..... 359/516
6,354,712 B1 * 3/2002 Anteby ..... 362/103
7,267,452 B2 * 9/2007 Esses ..... 362/103
7,390,103 B2 * 6/2008 Chang ..... 362/154

* cited by examiner

*Primary Examiner*—Jason Moon Han

(57) ABSTRACT

A waterproof vibrating and twinkling LED backlighting device includes: a main body (1), said main body (1) comprises a light-tight, hollow and polymorphous frame (11), and a transparent cover plate (12) installed on top of said frame (11); a circuit element (3), said circuit element (3) comprises a circuit board (31) and a circuit-control element (32) electrically connects with the circuit board (31); at least one light emitting device (4) which electrically connects with the circuit board (31), and its light emitting angle is parallel with the circuit board (31), said light emitting device (4) comprises: at least one Light-Emitting Diode (LED) (41) mounted on the side of the surface of said circuit board (31) and connected electrically with which; a power supply (5); a ball-rolling switch (6) electrically connects with the circuit element (3); and a transparent encapsulation body (2) filled inside the main body (1) to cover the circuit element (3), power supply (5) and ball-rolling switch (6).

10 Claims, 10 Drawing Sheets

VIBRATING AND TWINKLING LED BACKLIGHTING DEVICE

FIELD OF THE INVENTION

The present invention relates to a vibrating and twinkling LED backlighting device with variety uses.

DESCRIPTION OF PRIOR ART

The creation of LED (Light-Emitting Diode) helps the development of the semi-conductor industry; with technology advancing everyday, today's LED is smaller, brighter, and being used in our daily life more and more often. Lots of devices that we could only find in our imagination or science fiction before are now happening in the real life, such as the vibrating and twinkling LED backlighting device.

A conventional vibrating and twinkling device is consisting essentially of a circuit board, a LED electrically connects to the circuit board, an integrated circuit (IC) to control the twinkling of LED, a battery to supply power, and a vibrating switch to switch on/off operation of the device. Said vibrating and twinkling device has small size, but it can provide better lighting and twinkling effect. As decoration, said vibrating and twinkling device can draw people's attention, let the user to become the center of sights.

SUMMARY OF THE INVENTION

1. Problems to be solved:

Said vibrating and twinkling device has following drawbacks:

(1) The light of said vibrating and twinkling device is usually concentrated in a specific spot which limits the illuminating range of the device. It also limits the application area of the device because its simple lighting effect In accordance with the present invention, it is an objective thereof to change the illumination mode to expand the application area of the device.

(2) Said vibrating and twinkling device is limited by its structure, materials and lighting efficacy. With limit of the size, it can't be made into a larger object which decreases its range of use.

It is another objective of the present invention to solve limitation of the size, improving the light efficacy and extending its range of use.

2. Characteristics of the present invention:

The present invention is to provide a waterproof vibrating and twinkling device with backlighting illumination.

To solve above-mentioned problems, a vibrating and twinkling LED backlighting device as disclosed of the present invention comprises:

A main body (1) includes an opaque, hollow and polymorphous frame (11), and a cover plate (12) which is pervious to light disposed on the top of the frame (11) and corresponds to said frame (11);

A circuit element (3), disposed inside the main body (1), the circuit element (3) comprises a circuit board (31), and a circuit-control element (32) which electrically connects with the circuit board (31);

At least one light emitting device (4), electrically connected with the circuit of the circuit board (31) and the light emitting angle is parallel with the circuit board (31), said light emitting device (4) comprises: at least one Light-Emitting Diode (LED) (41) mounted on the side of the surface of said circuit board (31) and connected electrically therewith.

A power supply (5) electrically connected with the circuit element (3) for supplying power;

A ball-rolling switch (6) electrically connected with the circuit element (3) for controlling the operation of the circuit element (3).

A transparent encapsulation body (2) is filled inside the main body (1) to cover said circuit element (3), power supply element (5), and the ball-rolling switch (6);

When the ball-rolling switch (6) receives a vibration, the metal bead (62) contacts with said metal element (61) and the metal pole (61), it generates a trigger signal and when the circuit-control element (32) receives said trigger signal, it generates a driver signal to activate the light emitting device (4) to make the light emitting diodes twinkle in turn for a twinkle time.

Said ball-rolling switch (6) includes a hollow metal element (61), a metal bead (62), an insulating element (63) and a metal pole (64), said metal element (61) electrically connects with the circuit board (31), both ends of the metal element (61) are a sealing end (611) and an opening end (612), the metal bead (62) is movable mounted inside the metal element (61), the insulating element (63) is disposed in the opening end (612) of metal element (61), the metal pole (64) is inserted in the insulating element (63), one end of the metal pole (64) is inside the metal element (61), another end is electrically connected with the circuit board (31).

The ball-rolling switch (6) comprises a conductive plate (67) which electrically connects with the circuit board (31), a housing (68) covered said conductive plate (67), and at least one metal bead (62) is provided movably inside the housing (68) to provide current by contacting the circuit of said conductive plate (67), and a plurality of anode and cathode conductive points (671,672) are disposed in parallel formation on surface of the conductive plate (67).

The sealing end (611) of metal element (61) is formed by a metal cover (65) which electrically connects with the circuit board (31) and sheathing the outside of the metal element (61).

Said sealing end (611) of the metal element (61) electrically connects with circuit board (31) by following methods: welding, or connecting by a metal wire (66).

A first reflecting layer (311) with high reflectivity is mounted on the top of circuit board (31).

Said LED (41) can be one of the following: multi-color LED, mono-color LED or mixture of both.

Any trigger signal generated during the twinkling time will be disabled by said circuit-control element (32).

The circuit-control element (32) of said vibrating and twinkling LED backlighting device comprises:

- a trigger unit (33) connected electrically with the ball-rolling switch (6) to generate the trigger signal;
- a driving unit (34) to drive the LED (41);
- a control unit (35) to receive the trigger signal, and generate the driving signal to the driving unit (34) to make the LED (41) twinkling in turn for a twinkle time; and
- a delay unit (36) to determine the length of twinkling time of LED (41).

The encapsulation body (2) of said vibrating and twinkling LED backlighting device can be made by following materials: EPOXY, reactive adhesive (AB glue) or silica gel.

Regarding said vibrating and twinkling LED backlighting device, a second reflecting layer (111) with high reflectivity can be applied to the inner side of said frame (11).

Regarding said vibrating and twinkling LED backlighting device, a translucent or transparent chip (13) containing letters, color or figure is disposed on the bottom of the cover plate (12).

Regarding said vibrating and twinkling LED backlighting device, at least one groove (14) can be mounted under the bottom of the cover plate (12), and a translucent or transparent decoration (7) containing the letters, color or figure can fit in said groove (14).

Regarding said vibrating and twinkling LED backlighting device, a flange (112) is disposed around the bottom of frame (11) and can be secured on to an object by sewing or high frequency wave.

Said frame (11) and cover plate (12) can be coupled with each other by following methods: integral molding, co-injection molding, conjoint, adhesive bounding or high frequency wave.

3. Comparing to the prior art:

(1) One of the improvement of the present invention is the light emitting device (4) whereof light emitting angle is parallel with the circuit board (31), with installation of a transparent encapsulation body (2) and a high reflectivity frame (11) can change the illuminating area of a LED (41) from a specific spot to whole surface of the encapsulation body (2) providing backlighting illumination and improvement in lightening efficacy comparing to the conventional device.

(2) Another improvement of the present invention is using an encapsulation body (2) to provide better light-guiding ability. It also simplifies the structure of the device, reducing the cost, providing easier manufacture, and secures the elements inside the device. Its impermeability can protect the device against any malfunction caused by damp.

(3) Other improvement of the present invention is using combination of the metal element (61), metal bead (62) and metal pole (64) to allow the ball-rolling switch (6) having adequate sensitive conductivity, when there is insufficient sensitivity the metal bead (62) won't sense the slightly vibration, producing less twinkles as expected while over sensitivity may produce too much twinkles and reducing the life of the power supply unit (5).

(4) Furthermore, installation of a light-tight frame (11) and a transparent cover plate (12) in the main body (1) with a chip (13) and a decoration (7) allow the present invention having almost indefinite shapes. Less limitation of size with better illumination and being waterproof, the present invention may be applied to object such as: textile, badge, warning light of a bicycle, key chain, stationeries, shoes and other products.

DETAILED DESCRIPTION OF THE PREFERRED EMBODIMENT OF THE PRESENT INVENTION

The description of the preferred embodiment of the present invention is described in detail according to the appended drawings hereinafter.

Figure 1:
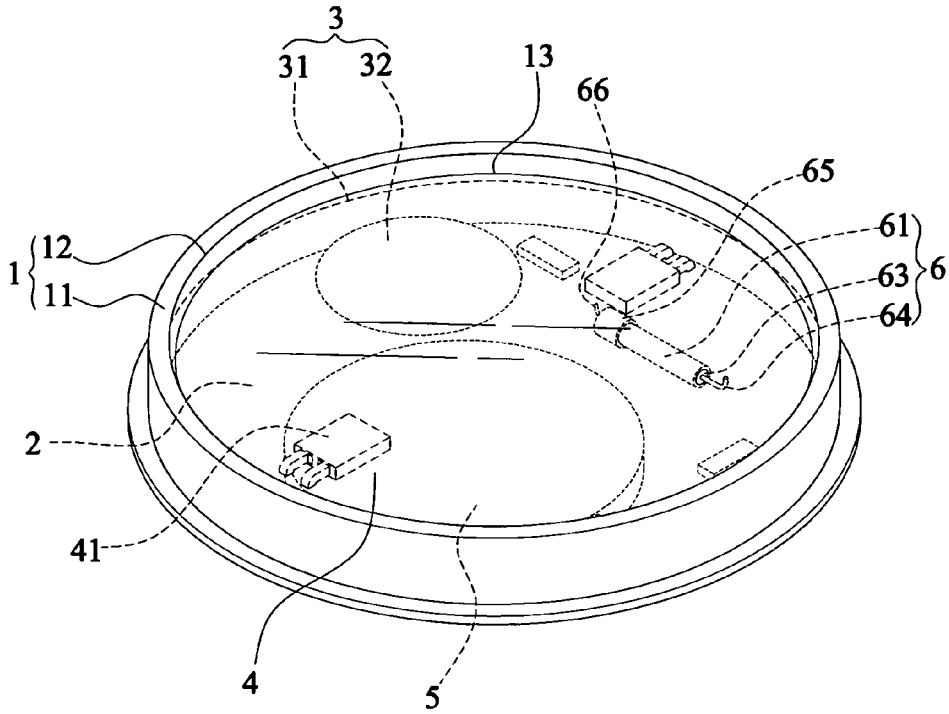
FIG. 1 is a schematic view of the first embodiment of the present invention.
Figure 2:
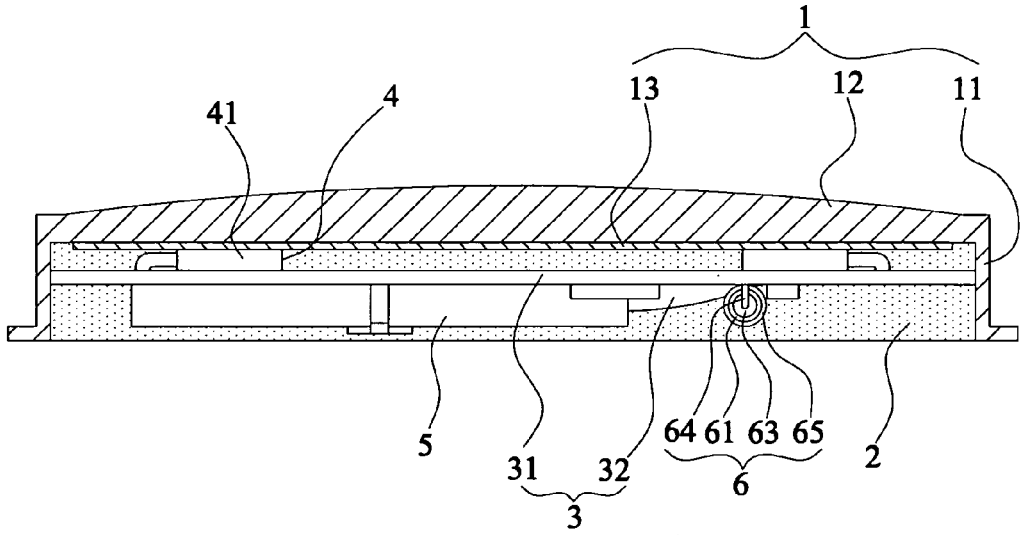
FIG. 2 is a whole cross sectional view of the first embodiment of the present invention.
Figure 3:
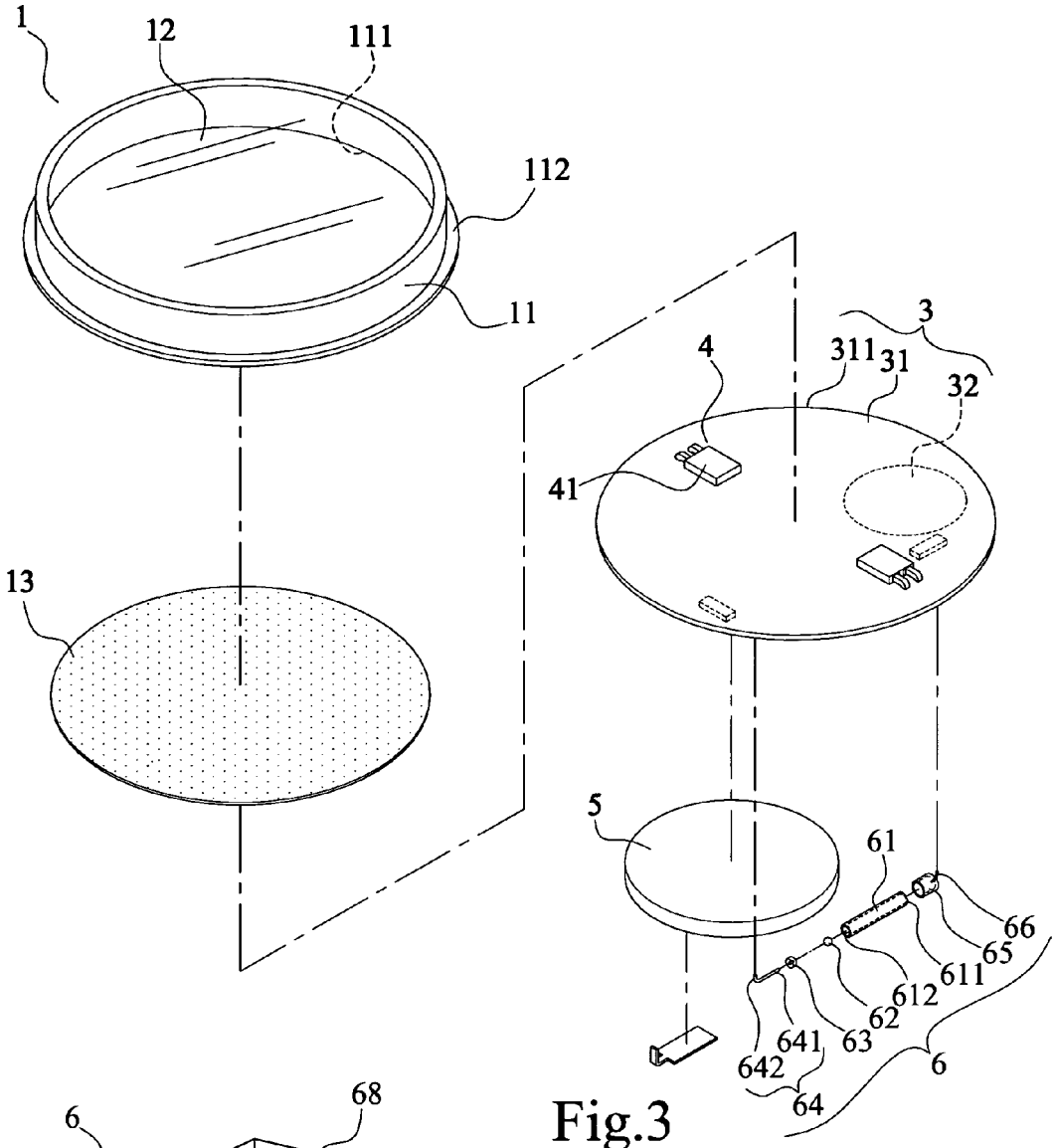
FIG. 3 is an exploded view of the first embodiment of the present invention.
Figure 3A:
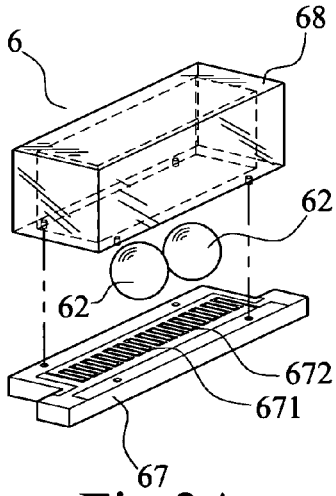
FIG. 3A is an exploded view of another ball-rolling switch which can be applied to the present invention.
Figure 7:
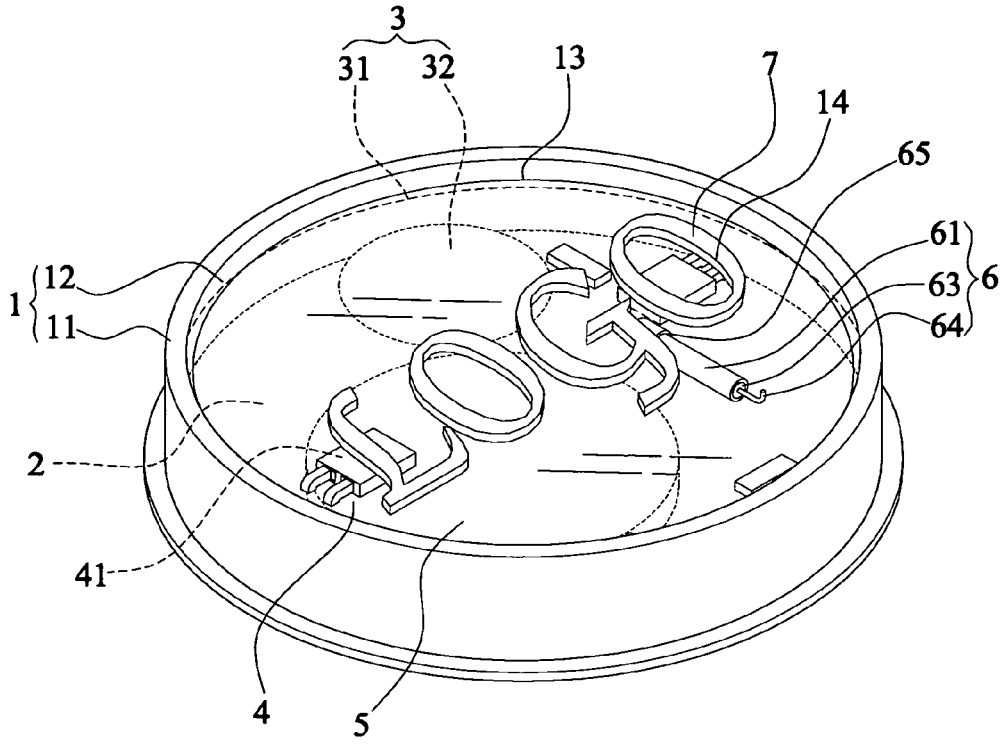
FIG. 7 is a schematic view of the module of the second embodiment of the present invention.
Figure 8:
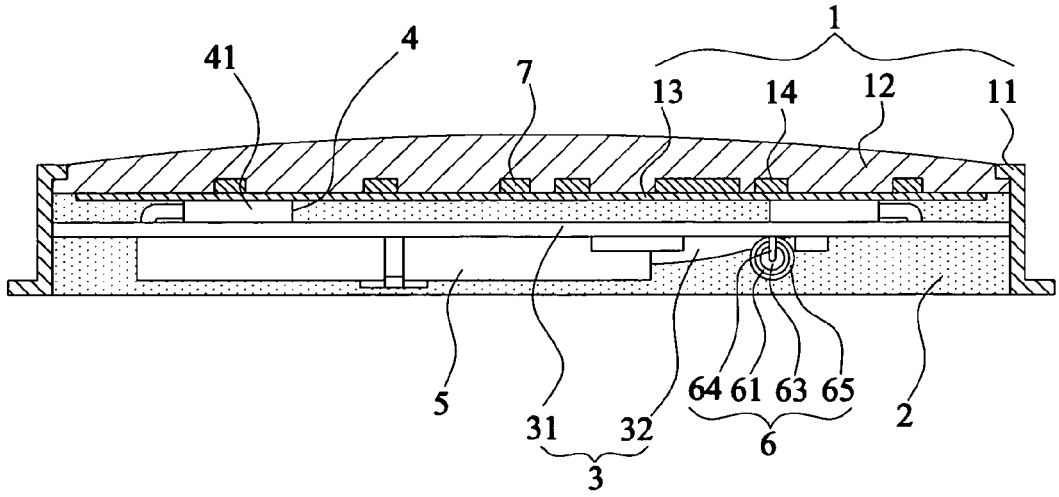
FIG. 8 is a whole cross sectional view of the module of the second embodiment of the present invention.
Figure 9:
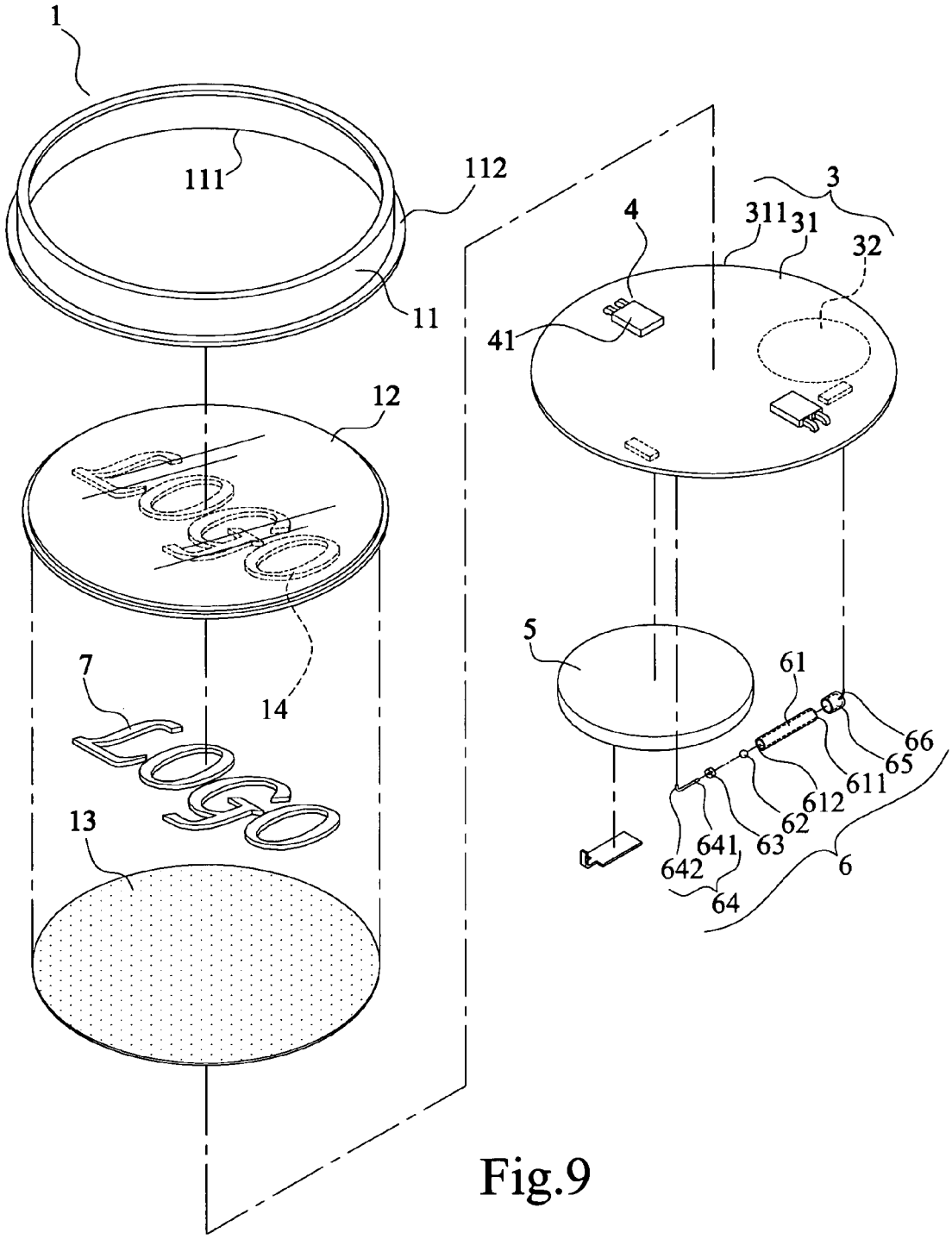
FIG. 9 is an exploded view of the module of the second embodiment the present invention.

FIG. 1 is a schematic view of the first embodiment of the present invention. FIG. 2 is a whole cross sectional view of the first embodiment of the present invention. FIG. 3 is an exploded view of the first embodiment of the present invention. FIG. 3A is an exploded view of another ball-rolling switch which can be applied to the present invention. FIG. 7 is a schematic view of the module of the second embodiment of the present invention. FIG. 8 is a whole cross sectional view of the module of the second embodiment of the present invention. FIG. 9 is an exploded view of the module of the second embodiment the present invention.

The first embodiment of the invention as shown in FIGS. 1-3 and 3A, a main body (1) comprises an opaque, hollow and polymorphous frame (11), and a cover plate (12) which is pervious to light disposed on the top of the frame (11) and corresponds to said frame (11);

A circuit element (3), disposed inside the main body (1), said circuit element (3) comprises a circuit board (31), and a circuit-control element (32) which electrically connects with the circuit board (31);

At least one light emitting device (4), electrically connected with the circuit of the circuit board (31) and the light emitting angle is parallel with the circuit board (31); said light emitting device (4) comprises: at least one Light-Emitting Diode (LED) (41) mounted on the side of the surface of said circuit board (31) and connected electrically therewith;

A power supply (5), electrically connected with the circuit element (3) for supplying power;

A ball-rolling switch (6), electrically connected with the circuit element (3) to control the operation of the circuit element (3); and A transparent encapsulation body (2) filled inside the main body (1) to cover said circuit element (3), power supply (5) and the ball-rolling switch (6);

When said ball-rolling switch (6) receives a vibration, it generates a trigger signal and the circuit-control element (32) receives said trigger signal, it generates a driver signal to activate the light emitting device (4) to make the light emitting diodes twinkle in turn for a twinkle time.

The light emitting device (4) wherein light emitting angle is parallel with the circuit board (31), with installation of a transparent encapsulation body (2) and a high reflectivity frame (11) can change the illuminating area of a LED (41) from a specific spot to whole surface of the encapsulation body (2) providing LED backlighting and improvement in lightening efficacy comparing to the conventional device.

Furthermore, the ball-rolling switch (6) of the present invention possesses adequate sensitive conductivity comparing to the conventional vibration switch by spring, when insufficient sensitivity won't sense slightly vibration of the metal bead (62), producing less twinkle as expected and over sensitivity may produce too much twinkle and reducing the life of the power supply unit (5).

Moreover, the encapsulation body (2) includes the following advantages:

(1) Producing good light-guiding ability.

(2) Simplified the structure of device by removing the installation of light-guiding element, it also decreases the cost (3) Efficient and easy manufacturing, less waste material will be produced, which can be considered as another way of reducing the cost;

(4) Protecting all elements by absorbing the shock.

(5) Good waterproofing, which can protect the device against any malfunction caused by damp.

Moreover, installation of a light-tight frame (11) and a transparent cover plate (12) in the main body (1) with the chip (13) and decoration (7) allow the present invention having variety changes. Less limitation of the size with better illumination and being waterproof, amplify the application area of the present invention Furthermore, the outside of cover plate (12) may be manufactured as convexity, to function as a convex lens, to centralize the light, allowing the present invention brighter and more attractive.

Also, the power supply (5) may be a small size battery such as a lithium battery for supplying sufficient power, with the control of circuit element (3) may prolong the using time of the battery.

The frame (11) and cover plate (12) of the present invention can be coupled with each other by following methods: integral molding, co-injection molding, halved joint, cement or high frequency wave.

Each method of assembly is suitable for different main body (1). For example integral molding and co-injection molding are applicable for the main body (1) whereof its frame (11) and cover plate (12) are integrated.

Others methods of assembly such as halved joint, cement or high frequency wave are applicable for the main body (1) whereof its frame (11) and cover plate (12) are manufactured separately. Different main body (1) may amplify the application area of the present invention.

As shown in FIG. 3, said ball-rolling switch (6) including a hollow metal element (61), a metal bead (62), an insulating element (63) and a metal pole (64), said metal element (61) electrically connects with the circuit board (31), both ends of the metal element (61) are a sealing end (611) and an opening end (612), the metal bead (62) is movable mounted inside the metal element (61), the insulating element (63) is disposed in the opening end (612) of metal element (61), the metal pole (64) is inserted in the insulating element (63), one end of the metal pole (64) is inside the metal element (61), another end is electrically connected with the circuit board (31).

When the present invention is positioned in a vertical plane, the metal bead (62) inside the ball-rolling switch (6) will roll toward and contact with the metal pole (64). The rolling metal bead (62) provides contact for the metal element (61) and the contacting end (641) of metal pole (64), which activates the light emitting device (4) to twinkle. Said ball-rolling switch is an effective, easy for manufacture and installation switch with adequate sensitivity.

The sealing end (611) of metal element (61) as mentioned above is formed by a metal cover (65) connecting electrically with the circuit board (31) and sheathing the outside of the metal element (61). Said sealing end (611) of the metal element (61) electrically connects to the circuit board (31) by the following methods: welding, or connecting by a metal conductive wire (66). By using the metal cover (65) for sealing the metal element (61), it facilitates the installation of the metal bead (62), also ensure constantly movement of the metal bead (62).

When the metal cover (65) is not used for closing the sealing end (611) of metal element (61), it may still electrically connect to the circuit of circuit board (31) by welding or conductive wire (66) for maintaining the normal operation of the ball-rolling switch (6).

Moreover, method such as coating can be used to apply a metallic conducting layer (not shown) on the surface of said metal element (61), metal bead (62), insulating element (63), metal pole (64) and metal cover (65), which it can increase conductivity for those components. The assembly of metal element (61) and metal cover (65) as two separated components as disclosed in said embodiment can make the process of coating the metallic conducting area on both elements easier.

As shown in FIG. 3A, another type of ball-rolling switch (6) has a conductive plate (67) which electrically connects with the circuit board (31), a housing (68) covered said conductive plate (67), and at least one metal bead (62) is provided movably inside the housing (68) to provide current by contacting the circuit of said conductive plate (67), and a plurality of anode and cathode conductive points (671,672) are disposed in parallel formation on surface of the conductive plate (67).

When said ball-rolling switch (6) receives a vibration, the metal bead (62) will roll on top of the conductive plate (67) and contact with the conductive points (671, 672), and allows the circuit-control element (32) receive the induction. Its adequate sensitivity is better than the conventional vibration switch with spring, therefore the lightening effect of LED (41) is more efficient.

A reflecting layer (311) and another reflecting layer (111), both with high reflectivity are mounted on the top of the circuit board (31) and inner periphery of the frame (11) respectively. Application of first reflecting layer (311) and second reflecting layer (111) on both top and inner periphery of the frame (11) can improve the LED backlighting, reducing light diffraction.

A translucent or transparent chip (13) containing letters, color or figure is disposed on the bottom of a cover plate (12). Combination of the chip (13) and LED backlighting, produced by light emitting device (4) can highlight the letters, color or figure of the chip (13), being more attractive and increasing its value as a decoration.

In FIGS. 7-9 showing a second embodiment of the present invention, a groove (14) is disposed on the bottom of the cover plate (12), and a translucent or transparent decoration (7) containing letters, color or figure can fit in said groove (14). The combination of the decoration (7), cover plate (12), and LED backlighting, produced by light emitting device (4) allow the decoration (7) illuminate as a billboard, and increasing its benefit when the decoration (7) represents a logo. The chip (13) of the preferred embodiment can also be applied here.

Said LED (41) as disclosed in both preferred and second embodiment can be one of the following: multi-color LED, mono-color LED or mixture of both as required. Combination of different LED (41) may provide variety changes of the device and increase its economic value.

Moreover, said encapsulation body (2) can be made by following material: EPOXY, reaction adhesive (commonly known as AB glue) or silica gel. Utilization of said flexible adhesives for manufacturing the encapsulation body (2), providing advantages such as waterproofing and protection for the invention, the most important is, said materials are impervious to light which can be used as a light guide. The structure and theory of said materials are commonly known by a person having ordinary skill in the art; therefore no more detail is described below.

Furthermore, a flange (112) is disposed around the bottom of the frame (11) and can be secured on to an object by sewing or high frequency wave. The flange (112) may help in positioning, reducing the deviation when fixing the device on an object. The coupling method is decided by the material of the object. For plastic object, high frequency wave is preferred and for wool, velvet and fabric object is suitable for sewing.

Figure 4:
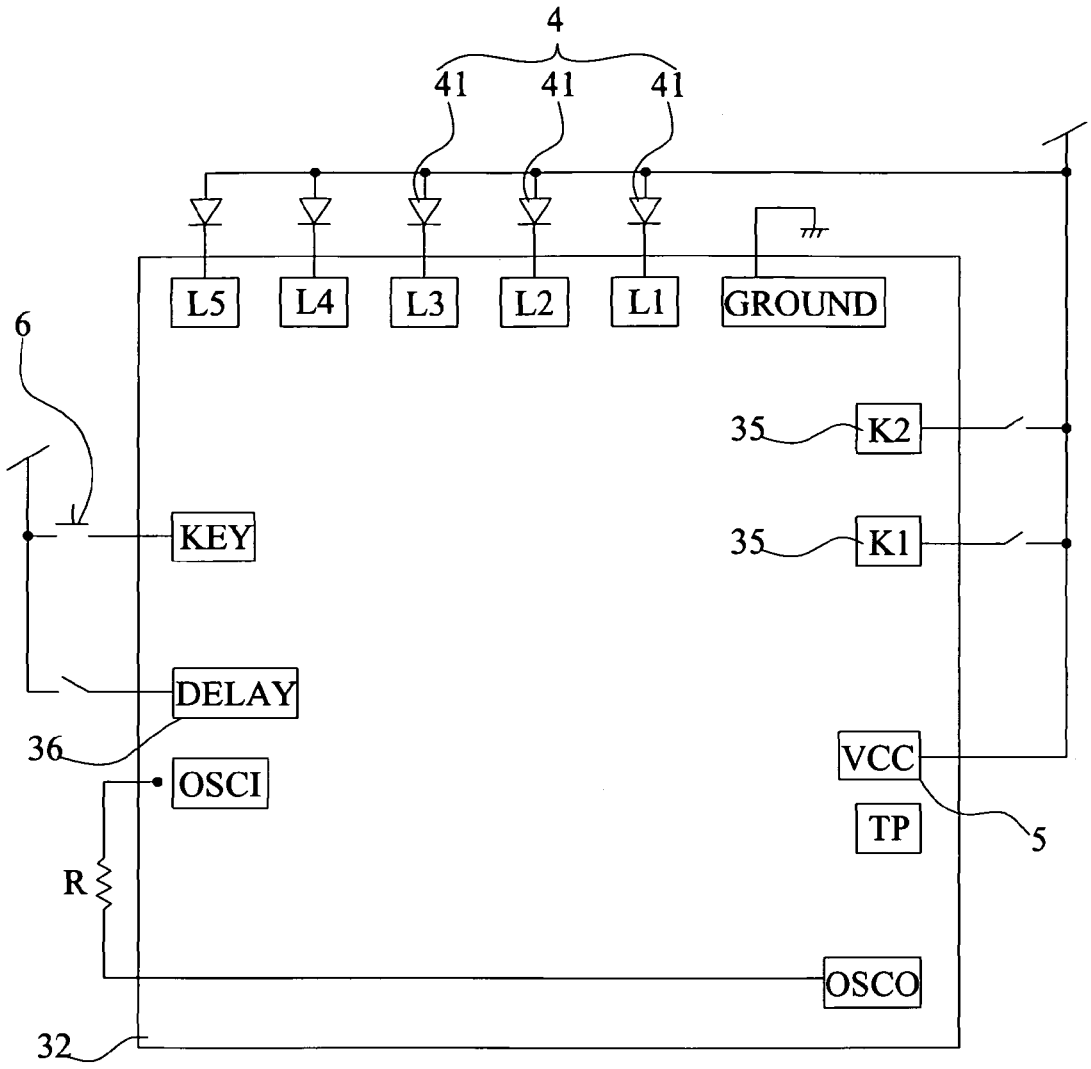
FIG. 4 is a circuit wiring diagram of a circuit control element of the present invention.
Figure 5:
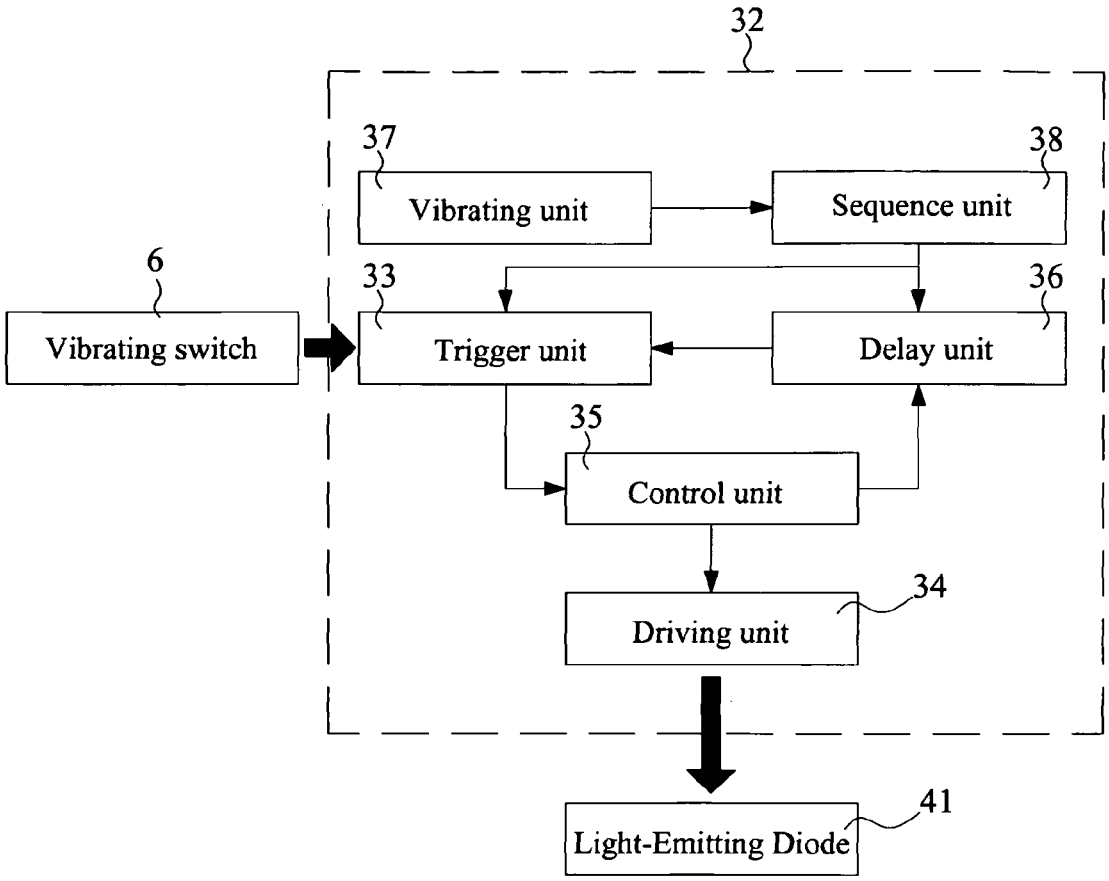
FIG. 5 is a flow chart of the circuit control element of the present invention.
Figure 6:
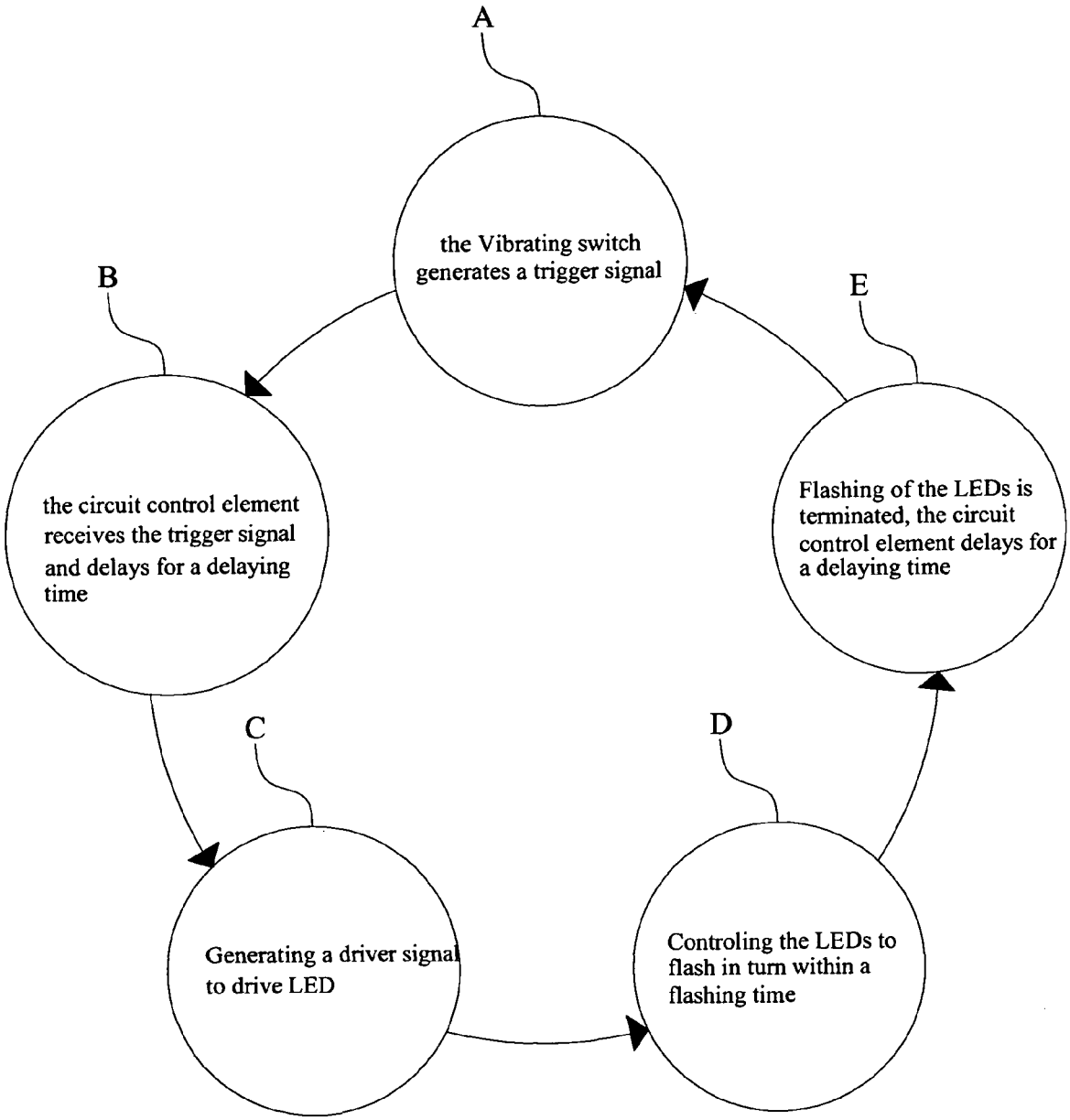
FIG. 6 is a flow chart of the present invention.

FIG. 4 is a circuit wiring diagram of a circuit control element of the present invention, and FIG. 5 is a flow chart of the circuit control element of the present invention.

As shown in FIG. 4 and FIG. 5, said circuit control element (32) comprises:

a trigger unit (33), connected electrically with the ball-rolling switch (6) to generate the trigger signal;

a driving unit (34) to drive the LED (41);

a control unit (35) to receive the trigger signal, and generate the driving signal to the driving unit (34) to make the LED (41) twinkling in turn for a twinkle time; and a delay unit (36) determines that circuit-control element (32) generates a driving signal and transmits the driving signal to the LED (41) within a twinkling time.

The vibrating unit (37) and the sequence unit (38) generate a work frequency for the trigger unit (33) and delay unit (36).

The delay unit (36) further controls the circuit-control element (32) and generates the driving signal for the LED (41) after delaying for a predetermined time set by the delay unit (36).

Alternatively, when the twinkling of LED (41) is over and the ball-rolling switch (6) is vibrated again, the delay unit (36) controls the trigger unit (33) to generate a trigger signal for the control unit (35) after delaying for a predetermined time.

Accordingly, any trigger signal generated within the twinkling time will be disabled by the control unit (35) of the circuit-control element (32).

The control unit (35) may includes two control switch (K1, K2), when both switches (K1, K2) work simultaneously, the control unit (35) controls the LED (41) to twinkle circularly in turn for N times based on actual demand. When one of the switches (K1, K2) works, the control unit (35) controls the LED (41) to twinkle circularly in turn for N±X times based on actual demand. When both switches (K1, K2) are not working, the control unit (35) controls the LED (41) to twinkle circularly in turn for N±Y times based on actual demand.

Additionally, the circuit-control element (32) may be electrically connected with plurality of LEDs (41), the delay unit (36), the power supply (5), the ball-rolling switch (6) and a vibrating resistance (R) through the printed circuits (not shown) of the circuit board (31).

As shown in FIG. 6 and FIGS. 10-12, the steps of the function of the vibrating and twinkling LED backlighting device of the present invention are listing as following:

[1] a ball-rolling switch generates a trigger signal (A);

[2] a circuit-control element (32) receives a trigger signal after delaying for a predetermined time (B);

[3] generating a driving signal for driving the SMD LED (C);

[4] controlling the SMD LED to twinkle in turn within a twinkling time (D); and

[5] when the twinkling is over, the circuit-control element (32) further delays for a predetermined time (E). Which means if the ball-rolling switch (6) is vibrated once again, the trigger unit (33) generates a trigger signal to the circuit-control element (32) after the delay time, and then repeats the above steps to avoid abnormal twinkling sequence of the LED (41) being.

Figure 10:
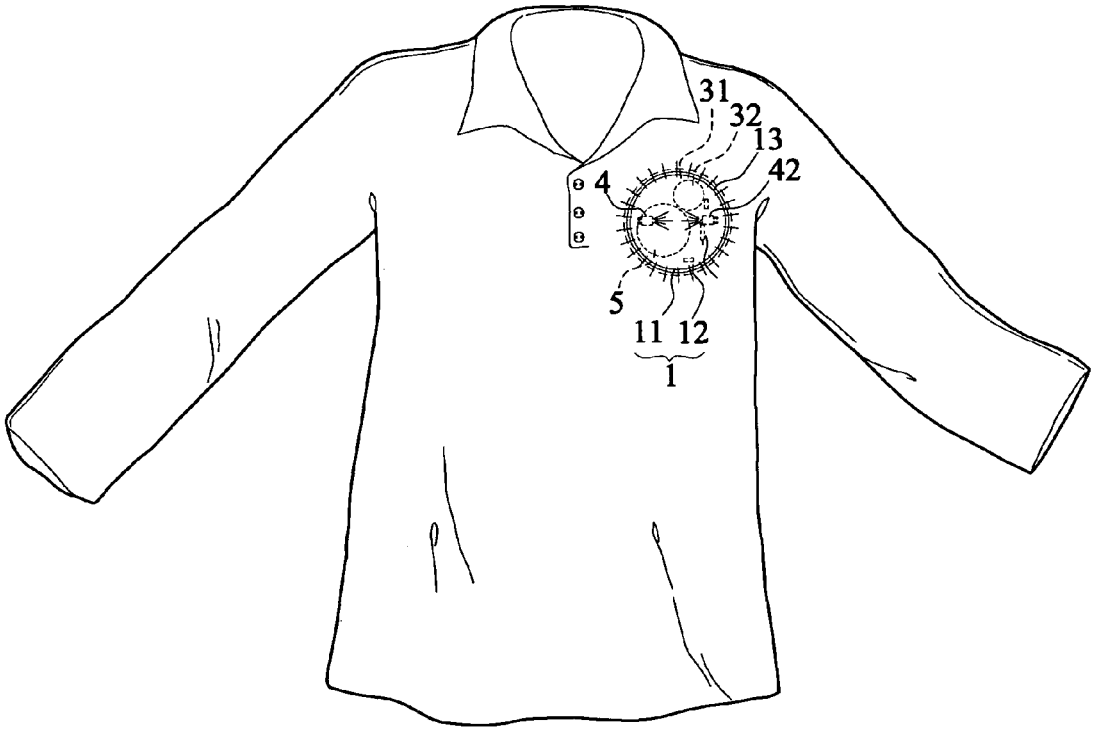
FIG. 10 is a schematic view of the present invention mounted on a textile.
Figure 11:
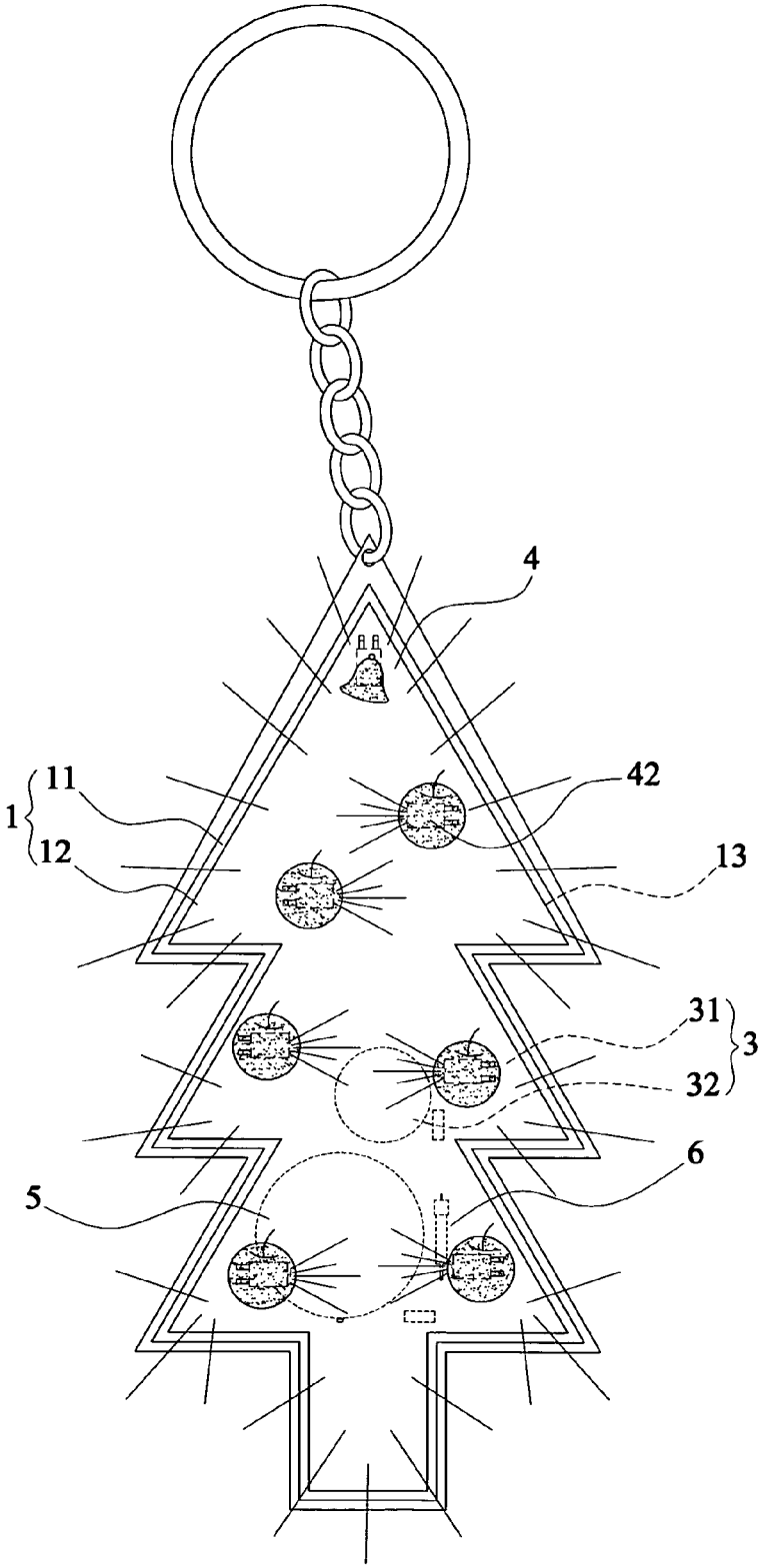
FIG. 11 is a schematic view of the present invention secured to a key chain.
Figure 12:
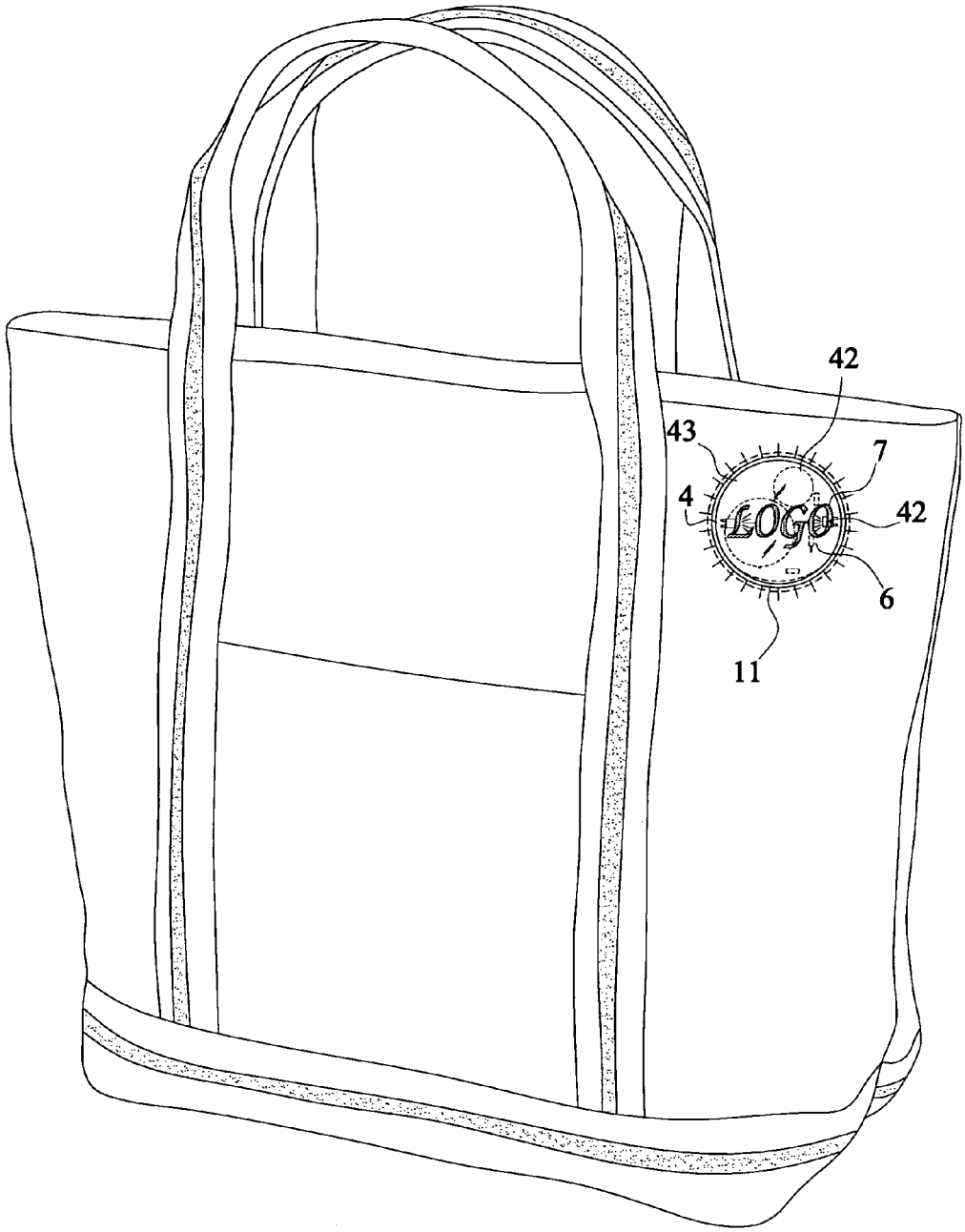
FIG. 12 is a schematic view of the present invention mounted on a handbag.

By combining variable main bodies (1), ball-rolling switches (6) with encapsulation body (2) the circuit board and light emitting devices (4) producing backlighting illumination (as shown in FIGS. 10-11), the present invention provides multiples types of entertainments and sensations, astonishing visual effects and endless innovations, also highlighting the uniqueness off each user. In this world where novelty is required in every product, the present invention will satisfy this demand for each user.

What is disclosed above is only the preferred embodiments of the present invention and it is therefore not intended that the present invention be limited to particular embodiments disclosed. It will be understood by those skilled in the art that various equivalent changes may be made depending on specification and drawings of present invention without departing from the scope of the present invention.

What is claimed is:

1. A vibrating and twinkling LED backlighting device, comprises:

a main body (1), said main body (1) comprises an opaque, hollow and polymorphous frame (11), and a cover plate (12) which is pervious to light disposed on the top of the frame (11) and corresponds to said frame (11);

a circuit element (3), disposed inside the main body (1), said circuit element (3) comprises a circuit board (31), and a circuit-control element (32) which electrically connects with the circuit board (31);

at least one light emitting device (4), electrically connected with the circuit of the circuit board (31) and the light emitting angle is parallel with the circuit board (31); said light emitting device (4) comprising: at least one Light-Emitting Diode (LED) (41) mounted on a side of the surface of said circuit board (31) and connected electrically therewith;

a power supply (5), electrically connected with the circuit element (3) for supplying power;

a ball-rolling switch (6), electrically connected with the circuit element (3) to control the operation of the circuit element (3); and a transparent encapsulation body (2) filled inside the main body (1) to cover said circuit element (3), power supply (5) and the ball-rolling switch (6);

whereby when said ball-rolling switch (6) receives a vibration, it generates a trigger signal and the circuit-control element (32) receives said trigger signal, and it generates a driver signal to activate the light emitting device (4) to make the LED (41) twinkles in turn for a twinkle time, wherein the ball-rolling switch (6) having a conductive plate (67) which electrically connects with the circuit board (31), a housing (68) covering said conductive plate (67), and at least one metal bead (62) is mounted movably inside the housing (68) to provide current by contacting the circuit of said conductive plate (67), and a plurality of anode and cathode conductive points (671, 672) are disposed in parallel formation on a surface of the conductive plate (67).

2. The vibrating and twinkling LED backlighting device as claimed in claim 1, wherein a reflecting layer (311) with a high reflectivity is mounted on the top of circuit board (31).

3. The vibrating and twinkling LED backlighting device as claimed in claim 1, wherein said LED (41) can be one of the following: multi-color LED, mono-color LED or mixture of both.

4. The vibrating and twinkling LED backlighting device as claimed in claim 1, wherein any trigger signal generated during the twinkling time will be disabled by said circuit-control element (32).

5. The vibrating and twinkling LED backlighting device as claimed in claim 1, wherein the circuit-control element (32) comprising:

a trigger unit (33), connected electrically with the ball-rolling switch (6) to generate the trigger signal;

a driving unit (34) to drive the LED (41) of said light emitting device (4);

a control unit (35) to receive the trigger signal, and generate the driving signal to the driving unit (34) to make said LED (41) twinkling in turn for a twinkle time; and a delay unit (36) to determine the length of twinkling time of said LED (41).

6. The vibrating and twinkling LED backlighting device as claimed in claim 1, wherein the encapsulation body (2) made from following material: EPOXY, reaction adhesive (AB glue) or silica gel.

7. The vibrating and twinkling LED backlighting device as claimed in claim 1, wherein a reflecting layer (111) with high reflectivity applied to the inner periphery of said frame (11).

8. The vibrating and twinkling LED backlighting device as claimed in claim 1, wherein a translucent or transparent chip (13) containing letters, color or figure is disposed on the bottom of the cover plate (12).

9. The vibrating and twinkling LED backlighting device as claimed in claim 1, wherein at least one groove (14) can be disposed on the bottom of the cover plate (12), and a translucent or transparent decoration (7) containing letters, color or figure can be fit in said groove (14).

10. The vibrating and twinkling LED backlighting device as claimed in claim 1, wherein a flange (112) is disposed around the bottom of the frame (11) and secured on to an object by sewing or high frequency wave.

* * * * *